US009597790B2

(12) United States Patent
Moschella et al.

(10) Patent No.: US 9,597,790 B2
(45) Date of Patent: Mar. 21, 2017

(54) UTILITY BOX WITH A SECONDARY LATCH

(76) Inventors: Marcello Alfredo Moschella, Gibsonia, PA (US); Daniela Buccilli, Gibsonia, PA (US)

( * ) Notice: Subject to any disclaimer, the term of this patent is extended or adjusted under 35 U.S.C. 154(b) by 1269 days.

(21) Appl. No.: 11/739,253

(22) Filed: Apr. 24, 2007

(65) Prior Publication Data

US 2008/0264946 A1 Oct. 30, 2008

(51) Int. Cl.
*B65D 45/16* (2006.01)
*B25H 3/02* (2006.01)
*A45C 13/10* (2006.01)

(52) U.S. Cl.
CPC ..... *B25H 3/02* (2013.01); *A45C 13/10* (2013.01); *Y10T 292/304* (2015.04)

(58) Field of Classification Search
CPC ..... A45C 13/10; B25H 3/02; Y10T 292/304
USPC ..... 220/324, 214, 326, 810, 834; 206/349; 292/80, 81, 87, 89, 121, 128, DIG. 11, 292/DIG. 49, 277
See application file for complete search history.

(56) References Cited

U.S. PATENT DOCUMENTS 2,286,739 A * 6/1942 Krause ..... 292/341.19
2,611,636 A * 9/1952 Metzger ..... 292/218
3,008,745 A * 11/1961 Tomkinson ..... E05C 19/14 292/113
3,134,617 A * 5/1964 Slonneger ..... 292/3
3,466,076 A * 9/1969 Bisbing ..... 292/109
3,709,538 A * 1/1973 Seitz et al. ..... 292/128
3,730,576 A * 5/1973 Schurman ..... 292/246
3,746,210 A * 7/1973 Evans ..... 220/633
3,909,050 A * 9/1975 Vicendese et al. ..... 292/128
4,830,413 A * 5/1989 Bisbing ..... 292/247
4,938,513 A * 7/1990 Gunderson ..... 292/80
4,964,661 A * 10/1990 Cadwell ..... E05C 19/06 292/337
4,971,372 A * 11/1990 Gunderson ..... 292/80
4,993,762 A * 2/1991 Rogers et al. ..... 292/303
5,169,018 A 12/1992 Fiore
5,176,281 A 1/1993 Fiore
5,193,706 A 3/1993 Hanna et al.
5,439,108 A * 8/1995 Lackie ..... 206/373
5,577,779 A * 11/1996 Dangel ..... 292/80
5,680,932 A 10/1997 Dickinson et al.
5,931,514 A * 8/1999 Chung ..... 292/89
6,254,251 B1 * 7/2001 Washington ..... B25H 3/02 362/154
6,736,265 B2 5/2004 Kipper et al.
6,942,257 B2 * 9/2005 Wong et al. ..... 292/128
7,017,740 B2 * 3/2006 Itzkovitch ..... B25H 3/02 206/372
2003/0106821 A1 6/2003 Bar-Erez

* cited by examiner

*Primary Examiner* — Anthony Stashick
*Assistant Examiner* — James M Van Buskirk
(74) *Attorney, Agent, or Firm* — Alan G. Towner, Esq.; Pietragallo Gordon Alfano Bosick & Raspanti, LLP

(57) ABSTRACT

A utility box with a primary latch and secondary latch for preventing accidental upset of a utility box is disclosed. The secondary latch may be a flexible type latch that automatically catches when the lid is closed. The secondary latch requires that a person disengage on the latch before opening the lid.

18 Claims, 5 Drawing Sheets

UTILITY BOX WITH A SECONDARY LATCH

FIELD OF THE INVENTION

The present invention relates to hinged lid utility boxes for carrying and/or storing articles and more particularly to article storage containers, such as tool boxes and tackle boxes.

BACKGROUND INFORMATION

People use utility boxes for a variety of reasons, for example storing tools, fishing tackle, ammunition or other articles. These boxes often have a hinged lid, a handle and one or more latches to secure the lid to the base of the box. These latches are typically a draw down type of latch. Draw down latches do a good job of securing the lid to the base of the box, however they require some user action in order to engage the latch. This can lead to a situation where the utility box is accidentally lifted without first being latched resulting in the box being upset and its contents being unintentionally emptied. The upset may cause personal injury or loss of property.

The present invention has been developed in view of the foregoing.

SUMMARY OF THE INVENTION

The present invention provides a utility box with a primary latch and secondary latch for preventing accidental upset of a utility box. The secondary latch may a flexible type latch that automatically catches when the lid is closed. The secondary latch requires that a person manually disengage the latch before lifting the lid.

An aspect of the present invention provides a utility box comprising a base, a lid hinged on the base, a primary latch for holding the lid in a closed position, and a secondary latch located on the base or the lid which automatically engages a catch located on the base or lid opposite the secondary latch.

Another aspect of the present invention provides an automatic secondary latch for a utility box having a hinged lid, the latch comprising a resilient member structured and arranged for mounting on either the base or the lid of the utility box, a catch structured and arranged for mounting on either the base or the lid of the utility box, wherein the resilient member and the catch are mountable on different ones of the base and lid for automatically latching the base and the lid when the lid is in a closed position.

Yet another aspect of the present invention provides a method of automatically latching a utility box having a base, a hinged lid, and at least one primary latch, the method comprising automatically latching a secondary latch when the lid is in a closed position with respect to the base, whereby the lid is maintained in the closed position if the utility box is lifted by the lid and the at least one primary latch is unlatched.

These and other aspects will become more apparent from the following description.

DETAILED DESCRIPTION

Figure 1:
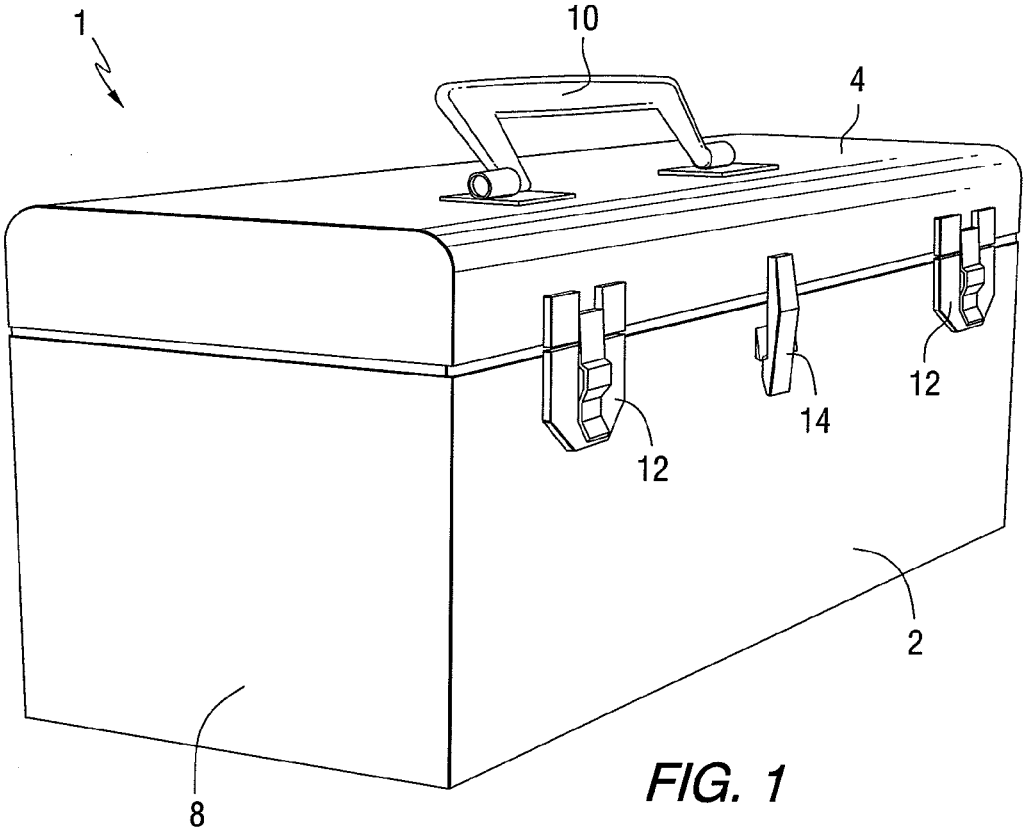
FIG. 1 is a perspective view of a utility box including primary latches and an automatically engaging secondary latch in accordance with an embodiment of the present invention.

Referring now to FIG. 1, a utility box 1 according to one embodiment of the present invention is shown. As used herein, a utility box refers to a container with a top or side mounted hinged lid capable of storing and/or carrying articles. In the embodiment shown in FIG. 1, the utility box 1 has a base 2 with a hinged lid 4 mounted thereon. Hinges (not shown) attach the hinged lid 4 to the base 2 along the rear face (not shown) of the utility box 1. The utility box 1 may have a front face opposite the rear face and sides 8. A handle 10 is affixed to the hinged lid 4. Primary latches 12 hold the hinged lid 4 in a closed position. Primary latches 12 may be, for example draw type latches, tension latches, loop catches, spring latches or other suitable latches or clasps. The secondary latch 14 is a resilient type latch, which engages automatically upon closing the hinged lid 4.

Figure 2:
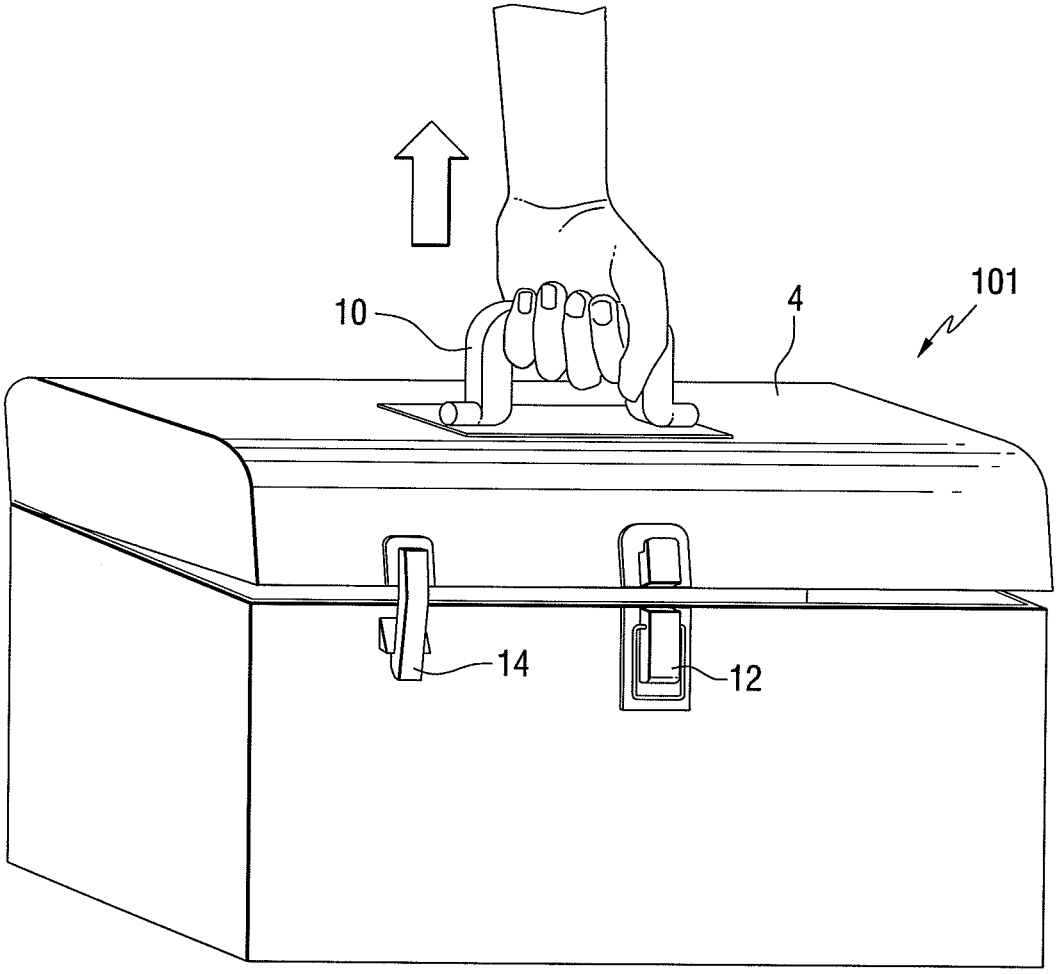
FIG. 2 is a perspective view of a utility box including a primary latch and an automatically engaging secondary latch in accordance with another embodiment of the present invention, showing the effectiveness of the secondary latch.

Referring now to FIG. 2, a utility box 101 is shown according to one embodiment of the present invention. A primary latch 12 is shown in an unengaged position. When a person lifts the utility box 1 by handle 10 the secondary latch 14 is engaged and prevents the box from upsetting and spilling its contents. The secondary latch 14 is intended to be a safety feature, which prevents the accidental upset from happening.

Figure 3:
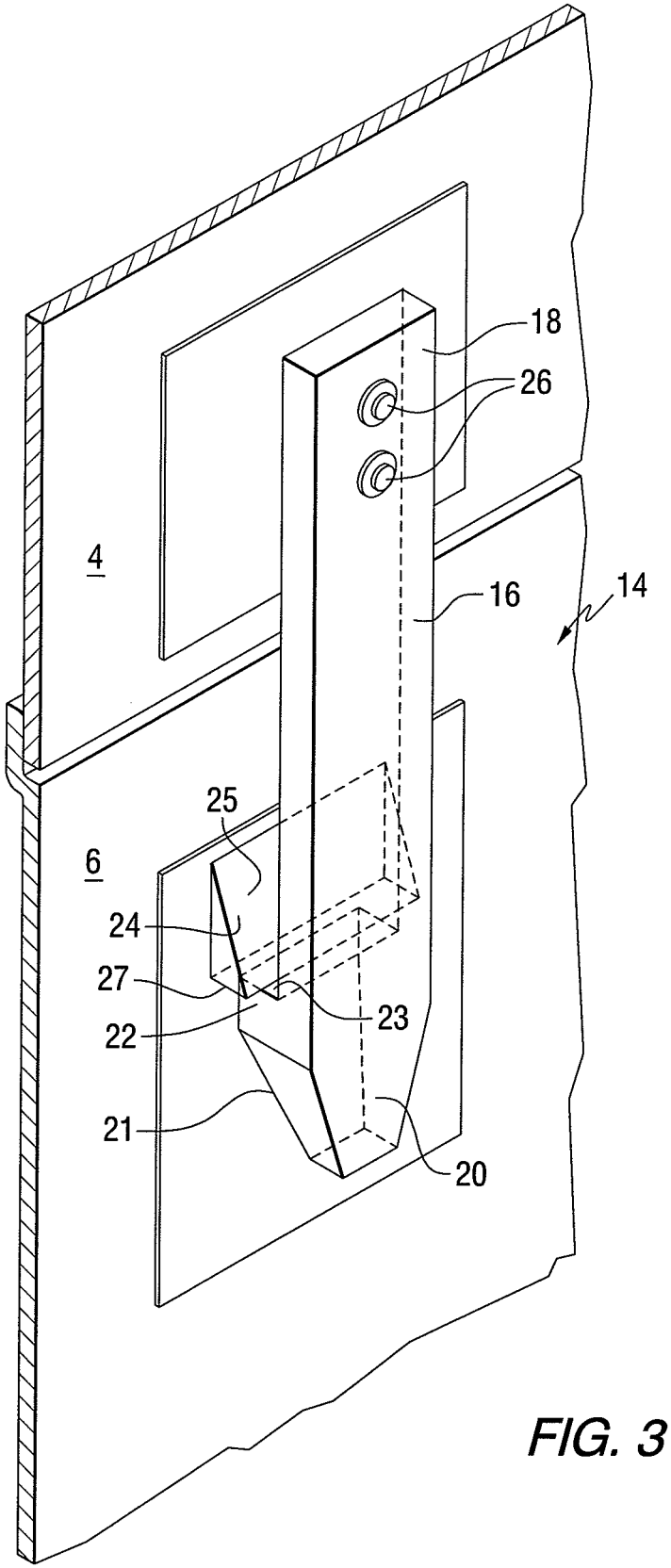
FIG. 3 is a detailed perspective view of an automatically engaging secondary latch according to one embodiment of the present invention.

As seen in FIG. 3, a secondary latch 14 may consist of a resilient member 16 affixed to the hinged lid 4 at a fixed end 18 of the resilient member 16. Fixed end 18 may be attached to the hinged lid 4 by fasteners 26. The fasteners may be rivets or other mechanical fasteners. Alternatively, the fixed end may be molded into a plastic utility box or welded into a metallic box. The resilient member 16 also has a nose 20 opposite the fixed end 18. The nose 20 has a projection 22 which engages a catch 24. The catch 24 is affixed to the front 6 of the base 2 as can be seen from FIG. 3. The projection 22 and catch 24 are inclined relative to each other, each having an inclined surface 21, 25, so that when the hinged lid 4 is closed the resilient member 16 flexes outwardly so the nose 20 passes over the catch and returns to an inward position after passing the catch 24. In this position an upward force on the hinged lid 4 causes a projection locking face 23 to engage a catch locking face 27 to prevent the hinged lid 4 from opening. In order for the lid to be opened a person needs to pull outwardly on the nose 20 of the resilient member 16 so that protrusion 22 may pass over catch 24.

Figure 4:
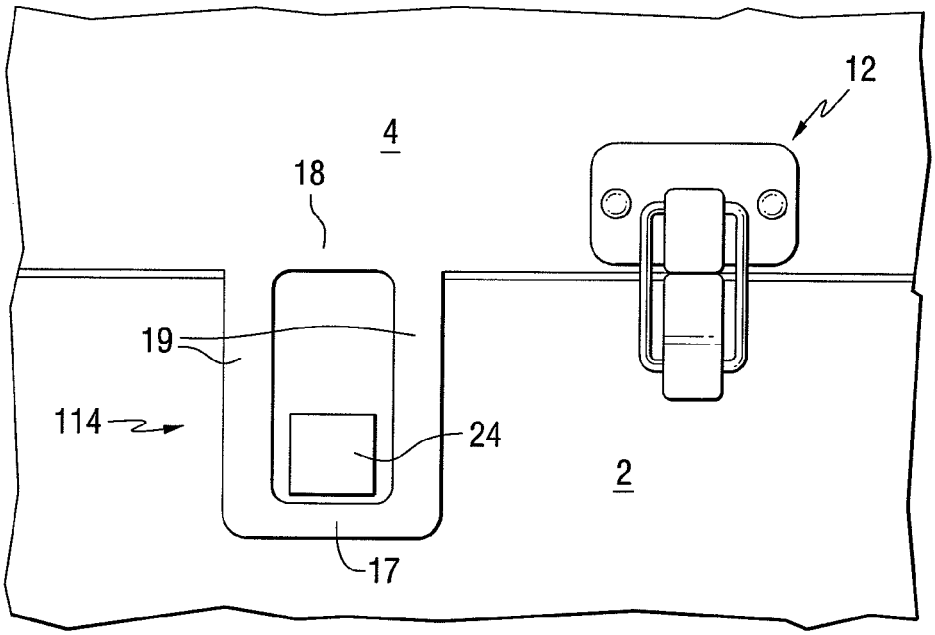
FIG. 4 is a detailed view of a primary latch and an automatically engaging secondary latch according to one embodiment of the present invention.

Another embodiment of the secondary latch of the present invention is shown in FIG. 4. In this embodiment, the resilient member is a U-shaped piece having two legs 19 and a cross-member 17. The resilient member may be affixed to the hinged lid 4 as an integrally molded piece of the hinged lid 4 as seen in FIG. 4 or may been affixed to the hinged lid 4 in another suitable manner, for example by mechanical fasteners. The secondary latch 114 in this embodiment is substantially flat. The catch 24 in the embodiment shown in FIG. 4 may be structured similarly to the catch shown in FIG. 3. Accordingly, as the hinged lid 4 is closed the cross member 17 engages the inclined surface 25 of the catch 24. Upon reaching the closed position, the cross member 17 is below the catch 24 and the resilient nature of the secondary latch 114 draws the cross member 17 towards the base 2. From this position, upward force of on the secondary latch 114 engages the cross member 17 with the catch locking face. As described above, the secondary latch 114 will need to be manually disengaged from the catch 24 to open the hinged lid 4.

Figure 5:
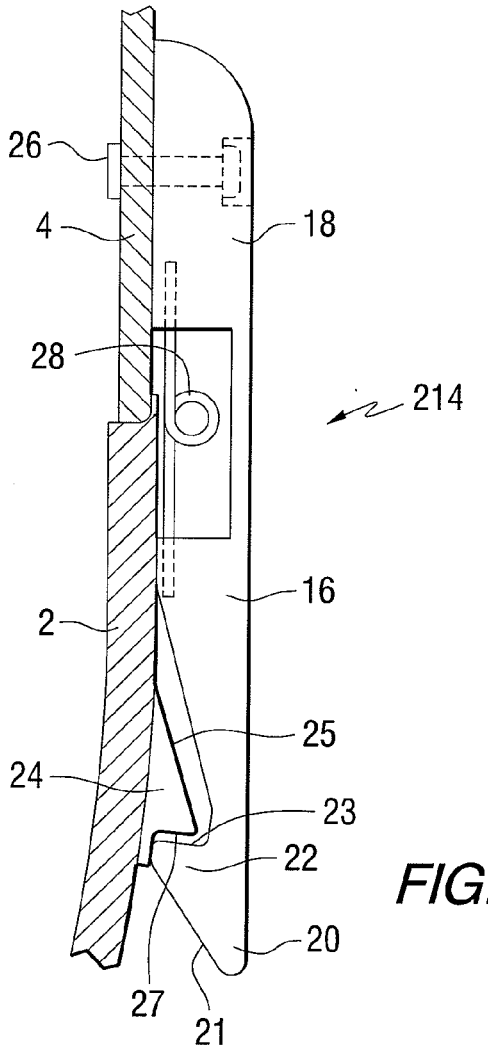
FIG. 5 is a side view of an automatically engaging secondary latch and cross section of a base and hinged lid according to one embodiment of the present invention.

Referring now to FIG. 5, another embodiment of the secondary latch 14 is shown. In this embodiment a spring 28 is incorporated into the resilient member 16 of the secondary latch 214. One end of the wire of the spring 28 extends into the fixed end 18 and the other end extends toward the nose into the resilient member 16. The spring 28 is configured to draw the nose toward the base 2. As the hinged lid 4 is closed the projection 22 passes over the catch 24. Once the nose 22 clears the catch 24, the spring 28 ensures the resilient member 16 flexes the nose 22 toward the base 2. From this position the hinged lid 4 cannot be opened until the nose is pulled away from the base 2. The spring may be any wire form spring, for example a torsion spring or double torsion spring.

Figure 6A:
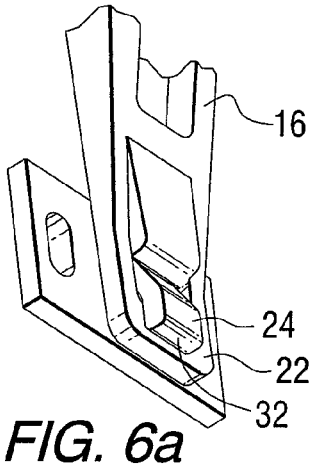
FIGS. 6*a* and 6*b* is a perspective view of a secondary latch according to one embodiment of the present invention.
Figure 6B:
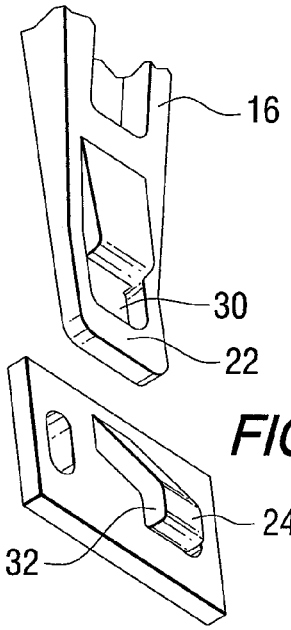

Referring now to FIGS. 6*a* and 6*b*, another embodiment of the secondary latch is shown. In this embodiment an aperture 30, best shown in FIG. 6*b*, is incorporated adjacent the nose 22 of the resilient member 16 of the secondary latch. The catch 24 has an extension 32, which securely interlocks with the aperture 30 when the lid is in the closed position as shown in FIG. 6*a*.

Figure 7:
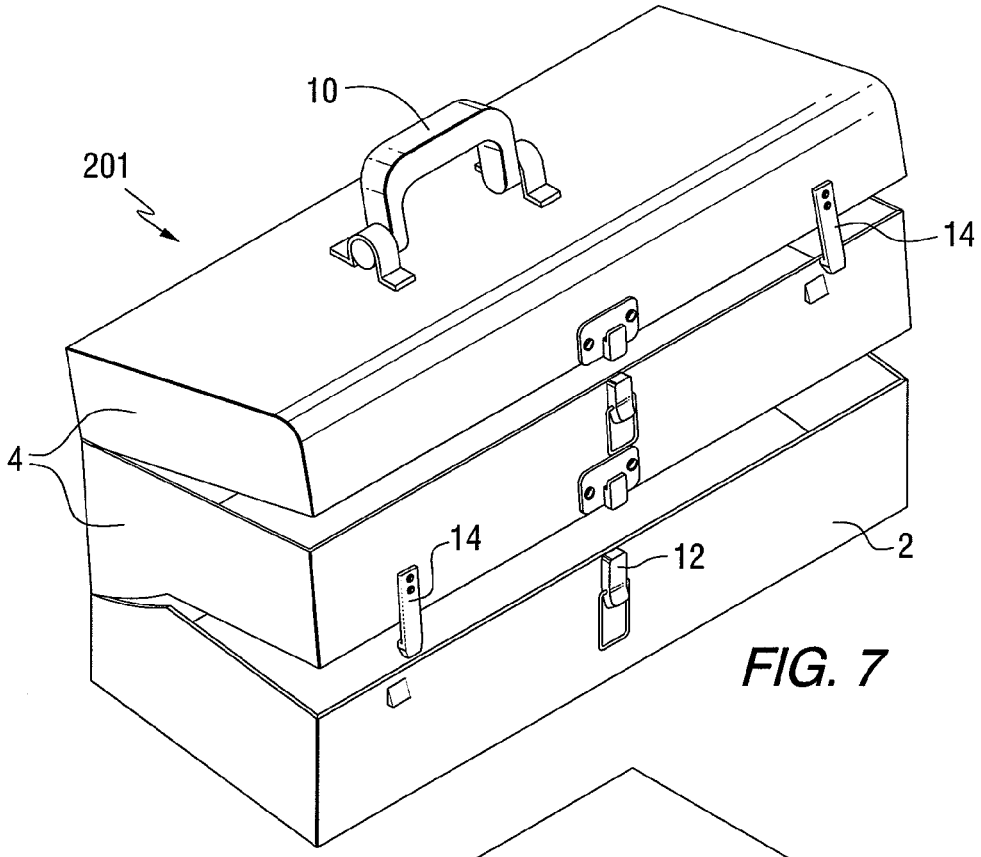
FIG. 7 is a utility box with two upwardly opening lids according to one embodiment of the present invention.
Figure 8:
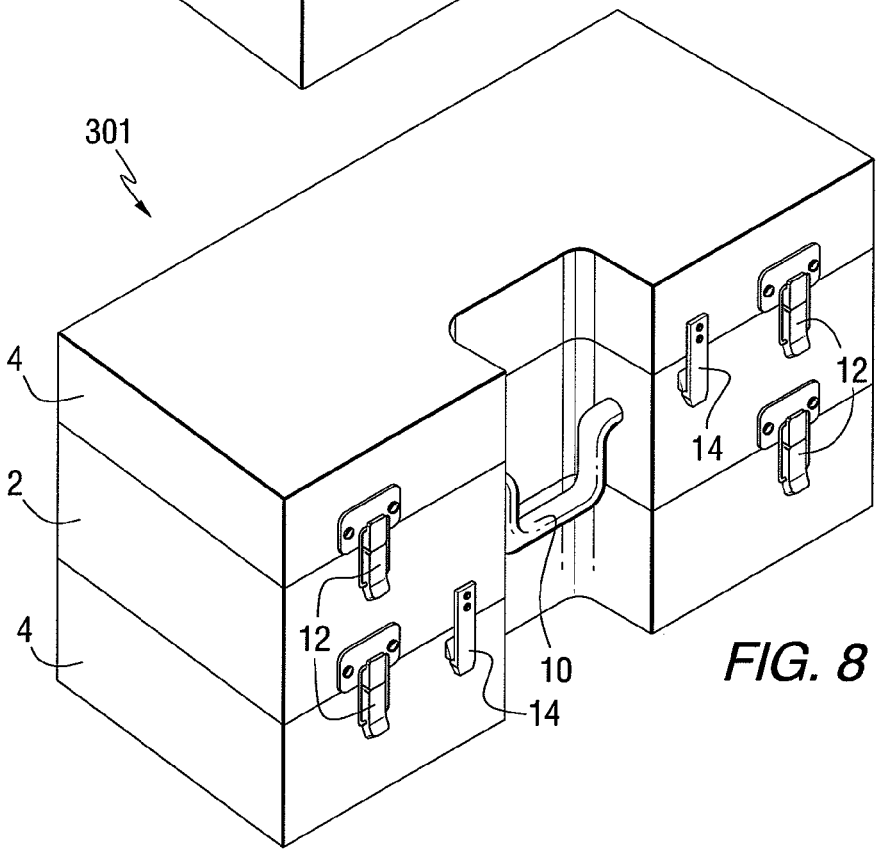
FIG. 8 is a utility box with a central base and opposed lids according to another embodiment of the present invention.

FIGS. 7 and 8 show other non-limiting examples of utility boxes according to the present invention. FIG. 7 shows a utility box 201 with multiple hinged lids 4. In this embodiment, a first primary latch 12 and first secondary latch 14 secure the first hinged lid 14 to the base 2 and a second primary latch 12 and a second secondary latch 14 secure the second hinged lid 14 to the first hinged lid 14. Referring now to FIG. 8, satchel style utility boxes 301 have a central base 2 with one or more hinged lids 4 mounted on opposite sides of the base 2. Each hinged lid 14 may have a primary latch 12 and a secondary latch 14. As shown in FIG. 8, secondary latches 14 in combination with primary latches are similarly useful for preventing accidental spills of satchel style utility boxes 301.

Whereas particular embodiments of this invention have been described above for purposes of illustration, it will be evident to those skilled in the art that numerous variations of the details of the present invention may be made without departing from the invention as defined in the appended claims.

The invention claimed is:

1. A utility box comprising:

a base structured and arranged to store and carry articles;

a lid hinged on the base;

a handle attached to the lid structured and arranged for lifting and carrying the utility box;

a primary latch for holding the lid in a closed position; and a resilient secondary latch located on the base or the lid which automatically engages a catch located on the base or lid opposite the secondary latch when the primary latch is not fastened and after the lid is moved upwardly from the closed position, wherein the catch comprises an inclined surface that engages with the resilient secondary latch to force the resilient secondary latch outward from the base or lid against an inward force applied by the resilient secondary latch when the lid is moved from an open position toward the closed position, and wherein the inward force applied by the resilient secondary latch forces the resilient secondary latch inward toward the base or lid after the inclined surface of the catch passes over the resilient secondary latch, and wherein the secondary latch and catch comprise opposing locking faces that are not in contact with each other when the lid is in the closed position, but which move vertically toward each other to thereby engage each other when the lid is moved upward.

2. The utility box of claim 1, wherein the resilient secondary latch comprises a resilient member attached at a fixed end to the hinged lid and a nose opposite the fixed end engageable with the catch.

3. The utility box of claim 2, wherein the nose of the secondary member further comprises a projection facing the base and adjacent the nose.

4. The utility box of claim 3, wherein the catch is mounted on the base and structured and arranged to engage the projection of the resilient secondary latch.

5. The utility box of claim 2, wherein the resilient member is a flexible material.

6. The utility box of claim 2, wherein the resilient member is plastic.

7. The utility box of claim 2, wherein the resilient member is metal.

8. The utility box of claim 2, wherein the resilient member comprises a spring.

9. The utility box of claim 1, wherein the resilient secondary latch is fastened to the base or lid by mechanical fasteners.

10. The utility box of claim 1, wherein the resilient secondary latch is fastened to the base or lid by an adhesive.

11. The utility box of claim 1, wherein the resilient secondary latch is molded as part of the base or lid.

12. The utility box of claim 1, wherein the primary latch is a draw latch.

13. The utility box of claim 1, wherein the primary latch is a loop catch.

14. The utility box of claim 1, wherein the primary latch is a spring loaded latch.

15. An automatic resilient secondary latch for a utility box structured and arranged to store and carry articles having a hinged lid including a handle structured and arranged for lifting and carrying the utility box, the resilient secondary latch comprising:

a resilient member structured and arranged for mounting on either the base or the lid of the utility box; and a catch structured and arranged for mounting on either the base or the lid of the utility box, wherein the resilient member and the catch are mountable on different ones of the base and lid, wherein the catch comprises an inclined surface that engages with the resilient secondary latch to force the resilient secondary latch outward from the base or lid against an inward force applied by the resilient secondary latch when the lid is moved from an open position toward the closed position, and wherein the inward force applied by the resilient secondary latch forces the resilient secondary latch inward toward the base or lid after the inclined surface of the catch passes over the resilient secondary latch, and comprise opposing locking faces that are not in contact with each other when the lid is in a closed position against the base, and engage each other after the handle of the lid is grasped and the lid is moved from the closed position to thereby prevent the lid from further opening when the handle is used to lift the utility box.

16. A method of automatically latching a utility box having a base structured and arranged to store and carry articles, a hinged lid, a handle attached to the lid, and at least one primary latch, the method comprising automatically latching a resilient secondary latch by engaging the resilient secondary latch with a catch when the lid is in a closed position with respect to the base, whereby the resilient secondary latch engages the catch after the lid is moved from the closed position if the utility box is lifted by the handle on the lid and the at least one primary latch is unlatched, wherein the catch comprises an inclined surface that engages with the resilient secondary latch to force the resilient secondary latch outward from the base or lid against an inward force applied by the resilient secondary latch when the lid is moved from an open position toward the closed position, and wherein the inward force applied by the resilient secondary latch forces the resilient secondary latch inward toward the base or lid after the inclined surface of the catch passes over the resilient secondary latch, wherein the secondary latch and catch comprise opposing locking faces that are not in contact with each other when the lid is in the closed position, but which move vertically toward each other to thereby engage each other when the lid is moved upward.

17. The method of automatically latching a utility box having a base, a hinged lid, and at least one primary latch according to claim 16, further comprising manually latching the primary latch when the lid is in a closed position.

18. The method of automatically latching a utility box having a base, a hinged lid, and at least one primary latch according to claim 16, further comprising manually unlatching the resilient secondary latch to thereby allow the lid to be opened.

* * * * *